United States Patent [19]

Adamek

[11] 4,087,003

[45] May 2, 1978

[54] PACKAGE FOR STACKED ARRAY

[75] Inventor: David J. Adamek, Minneapolis, Minn.

[73] Assignee: Champion International Corporation, Stamford, Conn.

[21] Appl. No.: 707,116

[22] Filed: Jul. 21, 1976

[51] Int. Cl.[2] ..... B65D 81/14; B65D 85/30

[52] U.S. Cl. ..... 206/583; 206/497; 206/611; 206/634; 220/449; 426/106

[58] Field of Search ..... 206/521, 497, 432, 45.31, 206/45.33, 45.34, 45.14, 525, 583, 434, 435, 600; 229/DIG. 12, 14 BA, 14 BL, 14 C, 51 TS, 14 R, 37 R; 426/106

[56] References Cited

U.S. PATENT DOCUMENTS

| | | | |
|---|---|---|---|
| 2,759,654 | 8/1956 | Vander Lugt, Jr. | 229/14 C |
| 2,816,699 | 12/1957 | Nute et al. | 229/51 TS |
| 2,981,456 | 4/1961 | Armstrong et al. | 229/51 TS |
| 3,246,745 | 4/1966 | Stoker, Jr. | 206/419 |
| 3,312,337 | 4/1967 | Martin | 206/45.31 |
| 3,315,875 | 4/1967 | Praetorius | 229/51 TS |
| 3,406,814 | 10/1968 | Gulliver | 206/45.14 |
| 3,550,833 | 12/1970 | Rahenkamp | 229/14 BA |
| 3,669,337 | 6/1972 | Struble | 206/521 |
| 3,750,872 | 8/1973 | Bobb | 206/497 |
| 3,952,940 | 4/1976 | Malcolm | 229/14 BA |

FOREIGN PATENT DOCUMENTS

| | | | |
|---|---|---|---|
| 875,658 | 8/1961 | United Kingdom | 229/14 BA |
| 945,217 | 12/1963 | United Kingdom | 229/14 BA |

*Primary Examiner*—Steven E. Lipman
*Assistant Examiner*—Bruce H. Bernstein
*Attorney, Agent, or Firm*—Evelyn M. Sommer

[57] ABSTRACT

A protective package for a stacked array such as nestable potato chips or similar articles where it is desired to provide protection for the objects by spacing them away from the sides of the carton, which includes a rectangular tube-like carton lined with shrinkable plastic film which surrounds the array and is shrunk to suspend the array away from the sides of the carton, the film being attached to diagonally opposite corners of the carton.

1 Claim, 5 Drawing Figures

PACKAGE FOR STACKED ARRAY

BACKGROUND OF THE INVENTION

1. Field of the Invention

This disclosure relates generally to containers or packages which are designed to protect the contents, and more particularly to those packages designed to protect a nested array of delicate objects such as chips or the like.

2. Description of the Prior Art

Objects such as crackers have long been packaged in stacks which are individually wrapped with waxed paper and then placed within a carton. The individual articles within the stack lend strength to one another and unless there is a sharp direct blow, breakage is usually kept to a minimum. For more delicate objects such as potato chips the random shape normally requires them to be packaged in either a rigid container such as a can or loosely in a box or bag. There is always some amount of breakage, however, and the most successful alternative to this has been that shown in U.S. Pat. No. 3,498,798 which is for a cylindrical fibre can with a nested array of chips which are formed into a particular shape so that they will closely align in a stack. These cans are expensive and there is a need for a package which will serve the same purpose and yet be less expensive.

SUMMARY OF THE INVENTION

A paperboard carton which can be erected on conventional cartoning equipment and which is assembled into a standard rectangular tube with end closures and which has a shrinkable plastic film covering the panels of the tube on the inside but which is attached at two opposite diagonal corners so that when the array of objects is placed in the carton and the film is then shrunk by heat the stack will be suspended away from the sides of the carton.

DETAILED DESCRIPTION OF THE PREFERRED EMBODIMENT

For purposes of this application the stack will be referred to as 10 and it should be understood that the invention is not limited to any particular array of objects, but that it may include things such as crackers or potato chips or even a single elongated article which is of a very delicate nature such as a glass tube. The carton

Figure 2:
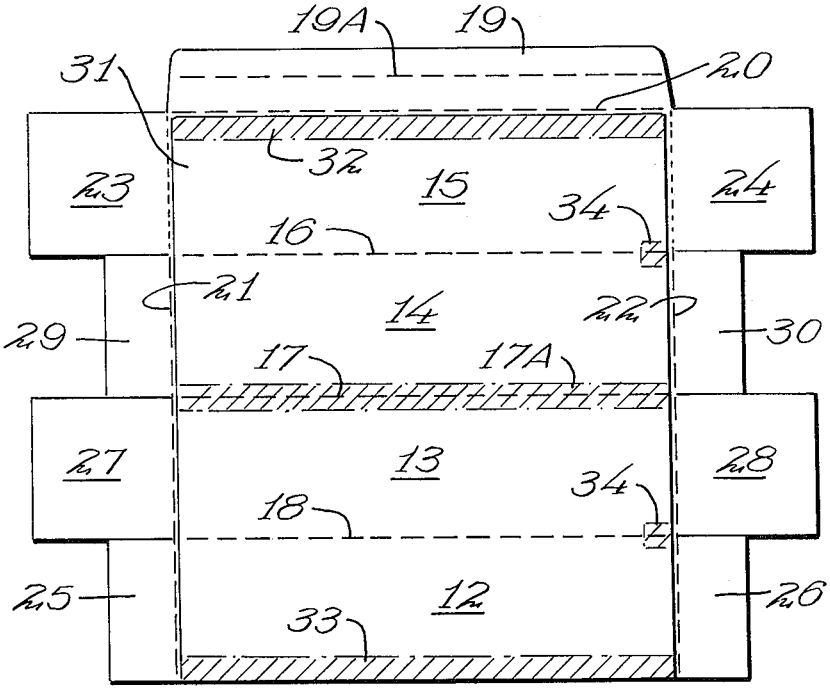
FIG. 2 is a plan view of a blank adapted to be erected into a carton and package embodying the present invention.

11 is one which is made from foldable paperboard or similar sheet-like material originally cut in a blank such as that shown in FIG. 2 which is substantially rectangular in shape and has four side wall panels 12, 13, 14 and 15 which are connected along horizontal fold lines 16, 17, and 18. In the particular configuration shown the panel 15 becomes the cover for the top of the carton and has connected thereto an insert flap 19 with a frangible score line 19A, all hingedly attached along fold carton is held in place by end closure flaps which are of a conventional configuration and are identified as being hingedly attached along vertical fold lines 21 and 22 which form the lateral extent of the blank. Attached to the top wall panel 15 are two flaps 23 and 24. Attached to the remaining wall panels 12, 13 and 14 are closure flaps 25, 26, 27, 28, and 29, 30 respectively.

It should be noted that the particular section of the hinge lines 21 and 22 which connect the end closure flaps 23 and 24 to the top wall panel 15 may be made in such a manner that they are frangible so that the top cover may be more easily raised and replaced by tucking the flap 19 on the inside of what becomes the front wall panel 12.

A thin sheet of heat-shrinkable plastic film 31 is adhesively attached to the surface of the blank which becomes the inside of the erected carton 11 and is adhesively attached at three locations. Those locations are the center hinge line identified as 17 with an adhesive area shown in the Figures as 17A and along the upper and bottom edges shown in the figures as hatched areas 32 and 33. These locations 32 and 33 are substantially contiguous in the final folded position and are diagonally opposite the glued area 17A.

Figure 1:
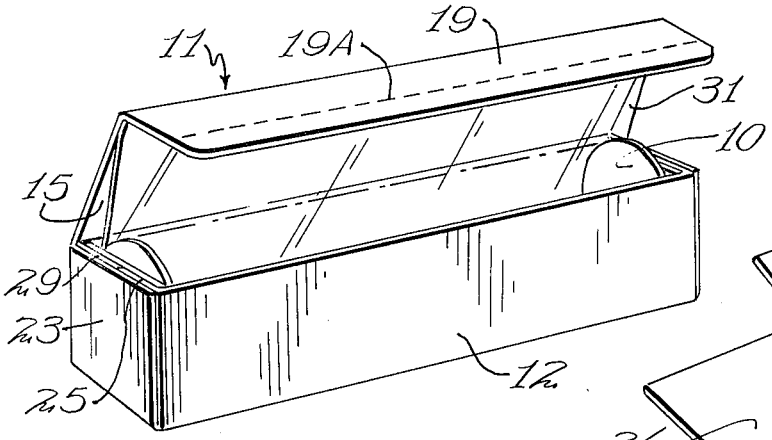
FIG. 1 is a perspective view of a carton embodying the present invention with the lid raised.
Figure 4:
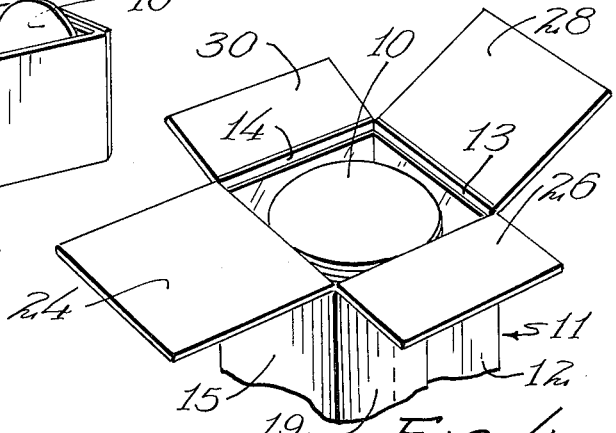
FIG. 4 is a perspective view of one end of the carton illustrating how the end flaps are opened to permit loading of the stack into the carton to provide the arrangement illustrated in FIG. 3.
Figure 3:
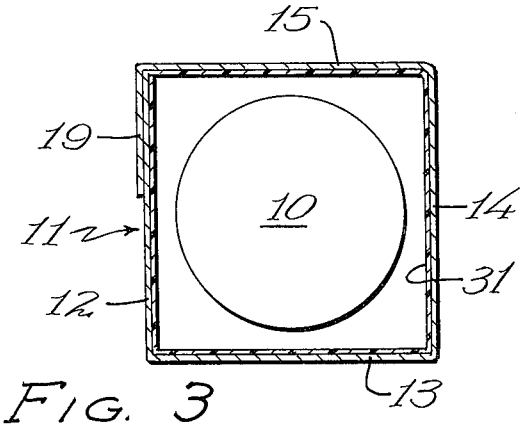
FIG. 3 is a side elevation view through a typical section of the package after the carton has been closed and the stack placed within the carton but before the film has been shrunk about the stack.
Figure 5:
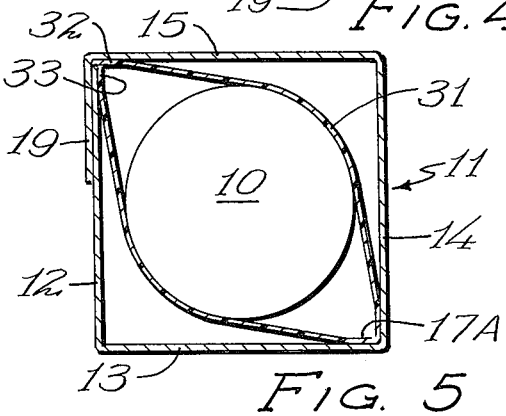
FIG. 5 is a typical cross section through the carton shown in side elevation view illustrating how the stack is suspended away from the sides of the carton by the film once heat has been applied thereto.

The carton 11 is erected by first gluing the closure flaps 23, 26, 27 and 29 and placing the overflap 19 in position on the front of the wall panel 12 and gluing if desired. The opposite end of the carton is then opened as shown in FIG. 4 and the stack of objects or object may be end loaded with automatic equipment and it should be noted that the film 31 is held into position against the sides of the carton 11 by small applications of adhesive 34 from which the film will break away when it is shrunk but would serve to hold the film tightly against the sides of the carton to provide as much latitude as possible during the loading process. The carton is then closed on the remaining end and subjected to heat to shrink the film about the stack or object to give the configuration seen best in FIG. 5.

I claim:

1. A package for an elongated object or a stacked array of objects, said package comprising:

a rectangular paperboard carton having dimensions slightly greater than the maximum lateral dimension of said object or said array;

said carton having front, bottom and rear panels connected along parallel fold lines and a top panel hingedly connected to the upper edge of said rear panel;

a top cover closure flap extending the length of said top cover and hingedly connected along an edge opposite said rear panels, said flap positioned exterior of the upper portion of said front panel as a manufacturer's joint;

end closure flaps attached to the ends of at least said top panel, said flaps connected to said top panel along frangible score lines;

a rectangular sheet of shrinkable plastic film surrounding said array along its lengthwise extent;

a first edge of said sheet of film adhesively attached to said carton adjacent the upper edge of said front panel on the inner facing surface thereof;

said sheet adhesively attached along its midpoint to the inner surface of said carton near the hinge line connecting said bottom and rear panels;

the remaining edge of said sheet of film adhesively attached to the inner surface of said carton adjacent the edge of said top panel opposite said rear panel; and said sleeve being shrunk into close conformity with said object or said array to suspend it away from contact with the panels of said carton.

* * * * *